United States Patent [19]

Anderson

[11] Patent Number: 4,625,529

[45] Date of Patent: Dec. 2, 1986

[54] LAUNDRY MACHINES

[75] Inventor: Iain Anderson, Auckland, New Zealand

[73] Assignee: Fisher & Paykel Limited, Auckland, New Zealand

[21] Appl. No.: 706,028

[22] Filed: Feb. 26, 1985

[30] Foreign Application Priority Data

Feb. 29, 1984 [NZ] New Zealand ..... 207317

[51] Int. Cl.[4] ..... D06F 37/24

[52] U.S. Cl. ..... 68/23.3; 248/612

[58] Field of Search ..... 68/3 R, 23 R, 23.1, 68/23.3; 210/144, 364, 380.2; 248/612, 613

[56] References Cited

U.S. PATENT DOCUMENTS

| | | | |
|---|---|---|---|
| 2,976,998 | 3/1961 | Smith | 210/364 X |
| 3,021,956 | 2/1962 | Bochan | 68/23.3 X |
| 3,361,398 | 1/1968 | Brinkman et al. | 248/613 |
| 4,537,382 | 8/1985 | Beck | 68/23.3 X |

FOREIGN PATENT DOCUMENTS

| | | | |
|---|---|---|---|
| 34569 | 3/1977 | Japan | 68/23.3 |
| 137567 | 12/1978 | Japan | 68/23.3 |
| 137568 | 12/1978 | Japan | 68/23.3 |
| 1071530 | 6/1967 | United Kingdom . | |
| 1187269 | 4/1970 | United Kingdom . | |
| 1355178 | 6/1974 | United Kingdom . | |
| 1390500 | 4/1975 | United Kingdom . | |
| 2082635 | 3/1982 | United Kingdom . | |

*Primary Examiner*—Philip R. Coe

*Attorney, Agent, or Firm*—Christie, Parker & Hale

[57] ABSTRACT

A laundry machine having a frame, a motor, transmission and driven parts suspended as a unit from the frame by a plurality of suspension means each having a rod, an upper and a lower two part coupling, each of which permits free relative angular movement between its parts within a desired range of movements is provided with restraining means between the unit and the frame, the restraining means restraining twisting of the unit relative to said frame beyond predetermined limits.

5 Claims, 3 Drawing Figures

LAUNDRY MACHINES

This invention relates to laundry machines.

It is an object of the present invention to provide a laundry machine which will at least provide the public with a useful choice.

Accordingly the invention consists in a laundry machine comprising a frame, a motor, transmission and driven parts suspended as a unit from said frame and a plurality of suspension means supporting said unit from said frame, each suspension means comprising a rod, an upper two part coupling and a lower two part coupling, each said coupling permitting free relative angular movement between its parts within a desired range of movements and restraining means between said unit and said frame or means associated with said frame, said restraining means restraining twisting of said unit relative to said frame beyond predetermined limits.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings which in which.

Figure 1:
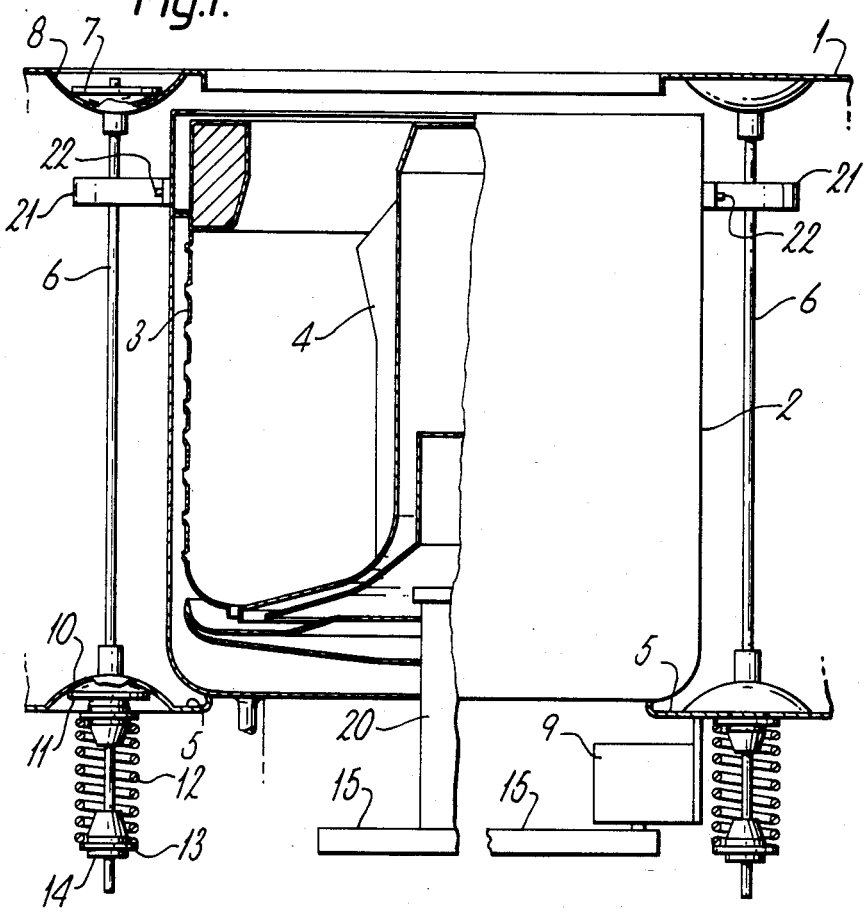
FIG. 1 is a part diagrammatic section of a laundry machine constructed according to the invention.
Figure 2:
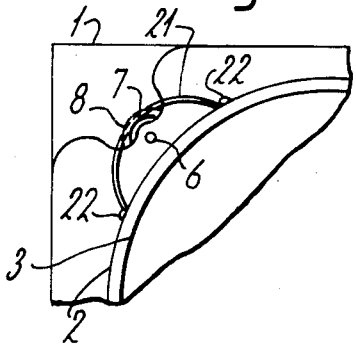
FIG. 2 is a scrap section showing a plan view of a suspension rod and associated restraining means according to FIG. 1.

The present invention is particularly concerned with the forces met with during braking of the rotating members of a clothes washing machine after spinning has occurred and to a lesser extent during acceleration to spinning speeds of such members. Thus referring to FIG. 1 of the drawings, the washing machine comprises a frame 1 in which is mounted a fixed barrel shaped water container 2 within which is a bowl shaped spin tub 3, the spin tub 3 in turn containing an agitator 4. The container 2 is supported by being mounted by brackets 5 from a plurality of and preferably four rods 6, each rod 6 having an upper spherical convex member 7 which is movable within a concave member 8 mounted on the frame 1.

Preferably there is a set, including a rod 6, a convex member 7, a concave member 8, a bracket 5, a concave member 10, a concave member 11, a spring 12, a washer 13 and a pin 14, interconnected and connected to the frame 1, as discussed above, at each corner of a rectangle. Only two such sets are shown in FIG. 1 by way of example. The brackets 5 are each connected to a concave member 10 in which a convex member 11 is supported by a spring 12 mounted on a washer 13 which is fixed by a circlip or pin 14 to the lower end of the respective rod.

Thus for each rod 6 the upper spherical convex member 7 and concave member 8 form an upper two part coupling and the lower convex member 11 and concave member 10 form a lower two part coupling each such coupling permitting relative angular movement between its parts within a desired range of movements.

Thus each rod 6 may move angularly relative to the frame 1 within limits.

The agitator 4 and the spin tub 3 are rotatable wash elements driven by a drive system (not shown) which includes an electric motor 9 off-set from the drive shaft axis 20 and the motor drives the spin tub and the agitator through a pulley system 15. The motor is supplied with electric current in a manner such that the agitator is reciprocally moved over an agitation cycle of something less than a full circle and an interconnecting means (not shown) is provided between the agitator and the spin tub so that when the agitator is driven continuously in one direction, the spin tub 3 is picked up and driven also in that direction. Brimer U.S. Pat. No. 3,914,963 discloses an agitator drive which when rotated continuously in one direction also drives the spin tub continuously in that direction.

In accordance with usual practice when spinning is effected, the agitator and spin tub are driven up to a quite high speed, for example 1100 rpm. Since the spin tub 3 contains wet clothes there are some out-of-balance forces as a result of which there is some movement of the unit comprising the container 2, agitator 4 and spin tub 3 and as a result some relative angular movement of the rods 6 relative to the frame 1.

When it is desired to stop spinning, for safety reasons and other purposes, it is desirable that the rotating mass be braked to stop spinning quickly. During such braking there is a tendency for the unit comprising the container 2, spin tub 3 and agitator 4 to move generally with a twisting action with some translation. Accordingly to resist such movement fixed, e.g. by rivets 22 connected to the upper part of container 2, restraining looped straps 21 are provided, one such strap 21 being provided for at least one and preferably for each rod 6.

The twisting container 2 takes up the slack in the straps and the straps now restrain the container top from further sideways or rotational movement. The straps 21 are of a flexible material, for example, a rubber belting or other synthetic belting material e.g. of a width of 20 mm and a thickness of 5 mm. The straps 21 together with parts of the container 2 are arranged to encircle the rods 6 but to have clearance therefrom and such clearance is such that in normal washing and spinning operations the straps do not serve any useful purpose though there may be some brushing of the straps against the rods 6 during spin-up or during movement resulting from out of balance effects. Thus the straps will act as dampers removing energy from the first natural vibration. However when braking is effected there is of course a considerable moment between the spinning members and the frame 1 and when this occurs the straps 21 pull against the rods 6 and as a result restrict sideways or rotational movement of the container 1 relative to the frame. This is of considerable advantage since it prevents the container 2 from bumping against the inner surfaces of the frame 1, with resultant noise which could give cause for alarm or concern to the operator.

Figure 3:
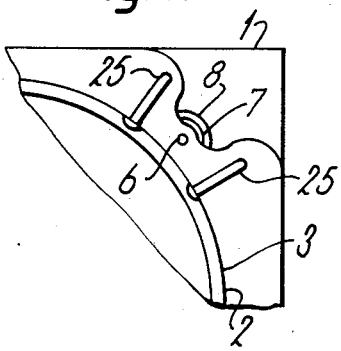
FIG. 3 is a scrap section showing a plan view of a suspension rod and an alternative form of restraining meanings.

Although the restraining means are described above as straps, other means could be employed, for example pins 25 (FIG. 3) may be fixed to the container 2 so as to extend substantially radially therefrom, there being for each rod 6 provided with restraining means, two pins 25 positioned one on either side of the appropriate rod 6 and the pins extending radially a sufficient distance as to ensure contact with the rod 6 when restraint is required.

Preferably such pins are made of a stiffly resilient material.

What is claimed is:

1. A laundry machine comprising:

a frame having an upper part;

a water container, a rotatable wash element in the container and a motor in driving relation with the rotatable wash element, the container, the rotatable wash element and the motor being suspended as a unit from the upper part of the frame;

a plurality of suspension means suspending the unit from the frame so as to provide an upper part of the unit and a lower part of the unit, each suspension means comprising a rod, a first two part coupling for coupling the corresponding rod to the upper part of the frame and a second two part coupling for coupling the lower part of the unit to the corresponding rod, each two part coupling being adapted to permit free relative angular movement between the parts thereof; and restraining means, for at least one of the suspension means, for coupling the upper part of said unit to the rod, in the corresponding restraining means, so as to restrain twisting of the unit relative to the frame beyond predetermined limits.

2. The laundry machine of claim 1 wherein the restraining means engages such rod between the first and second couplings.

3. The laundry machine of claim 1 wherein the at least one restraining means comprises at least one strap connected to the upper part of the unit, said at least one strap being looped and, together with part of said unit, encircling the rod in the corresponding suspension means and providing some freedom of movement of said at least strap relative to such rod.

4. The laundry machine of claim 1 wherein the at least one restraining means comprises at least one pair of pins spaced apart from the rod in the corresponding suspension means, the pins of said at least one pair of pins extending substantially radially from the upper part of the unit for a sufficient distance circumferentially on the container, one on each side of such rod, for a sufficient distance so as to engage such rod when restraint is required to be exercised.

5. The laundry machine of any of claims 1 through 4 wherein there is a restraining means for the rod in each of the suspension means.

* * * * *